United States Patent [19]

Stobb

[11] Patent Number: 4,819,929

[45] Date of Patent: Apr. 11, 1989

[54] APPARATUS AND METHOD FOR FEEDING SHEETS TO A SHEET GATHERER

[75] Inventor: Walter J. Stobb, Pittstown, N.J.

[73] Assignee: Stobb, Inc., Clinton, N.J.

[21] Appl. No.: 17,550

[22] Filed: Feb. 24, 1987

[51] Int. Cl.[4] ..... B65H 29/38

[52] U.S. Cl. ..... 271/177; 271/184; 271/185; 271/198; 271/314

[58] Field of Search ..... 271/176, 177, 178, 184, 271/185, 198, 314, 225, 149, 150, 6, 4, 3.1, 199, 202; 270/54

[56] References Cited

U.S. PATENT DOCUMENTS

| | | | |
|---|---|---|---|
| 3,522,943 | 8/1970 | Swanson | 271/6 |
| 3,680,854 | 8/1972 | Daily et al. | 271/3.1 X |
| 3,718,217 | 2/1973 | Stobb et al. | 270/54 |
| 3,858,490 | 1/1975 | Heisler | 271/150 X |
| 3,982,749 | 9/1976 | Stobb | 271/4 |
| 4,364,554 | 12/1982 | Akers | 271/198 X |
| 4,531,343 | 7/1985 | Wood | 53/399 |
| 4,588,180 | 5/1986 | Ballestrazzi et al. | 271/150 X |
| 4,618,136 | 10/1986 | Pessina et al. | 271/150 |

OTHER PUBLICATIONS

Advertisement, Portec Inc. Flomaster Division, Canon City, CO., perspective view enclosed and dated Jun. 7, 1966.

*Primary Examiner*—Joseph J. Rolla
*Assistant Examiner*—David H. Bollinger
*Attorney, Agent, or Firm*—Arthur J. Hansmann

[57] ABSTRACT

Apparatus and method of feeding sheets to a sheet gatherer, comprising moving the sheets along a horizontal path and then arcuately downwardly to lay the sheets in the gatherer hopper. The sides of the sheets are supported by members which have irregular surfaces disposed in vertical upstanding planes for engaging the opposite sides edges of the upstanding sheets and thereby support the sheets while advancing them toward the hopper. The sheets are continuously moved from a loading position and in the horizontal direction and then through a downwardly extending arc and into the hopper.

15 Claims, 1 Drawing Sheet

APPARATUS AND METHOD FOR FEEDING SHEETS TO A SHEET GATHERER

This invention relates to apparatus and method for feeding sheets to a sheet gatherer in the graphic arts industry.

BACKGROUND OF THE INVENTION

The graphic arts industry is concerned with the function of feeding or moving printed sheets or signatures from a stack or collection thereof and into a gathering apparatus so that the sheets can be collated. The present day popular way of accomplishing that function is to position a bundle of the sheets in a location adjacent a gatherer, and then to strip the sheets from the bundle in a shingled form and direct that shingled stream of sheets into the hopper of a feeder of those sheets. That prior art arrangement is shown in U.S. Pat. Nos. 3,522,943 and 3,982,749, by way of general examples. In that instance, the sheets must be taken from the initial bundle and positioned into a stream relationship, and the sheets are then again stacked in the desired quantity in the feeder hopper which requires that the sheets be positioned therein in only certain quantities, and thus the entire initial bundle cannot be placed into the hopper, but the stream feed is resorted to.

The present invention provides for apparatus and method for properly loading the hopper, but to do so without the requirement of placing the sheets into an initial stream prior to re-collecting them into a stack in the hopper. As such, the present invention improves upon the prior art in that it does not require that the sheets be placed into a stream of shingled sheets, but, instead, the sheets can be moved from the initial bundle and directly into the hopper while the sheets remain basically in their side-by-side relationship.

The advantage of the present invention is particularly appreciated when dealing with certain stock of sheet which does not shingle well, or when dealing with a great number of pages in each signature in the original stack, and, again, the signatures then do not accurately and easily enter into a shingled stream of signatures.

The present invention improves upon the prior art in providing for an improved method and apparatus for feeding sheets into a gatherer, such as the hopper of the gatherer, and to do so by moving the sheets directly from the initial bundle and into the hopper, without intervening apparatus or requirements for shingling or the like. In this improvement, sheets are therefore placed within the control of a conveyer which receives the initial stack of sheets and which continuously moves into a downwardly directed orientation to place the sheets into a reclining orientation in the hopper of the gatherer, all in an accurate and desirable manner of both alignment and quantity required by the gatherer. Further, in accomplishing this objective, the apparatus of the present invention is of a simplified construction, compared to the requirements of the prior art, but yet the present inventive apparatus is reliable and sturdy and is automatically controlled in feeding the sheets into the hopper in accordance with the automatic detection of the requirements of the hopper. Still further, the present apparatus and method provides for accommodating sheets of different widths and different types of stock and stacking requirements, and thus the present invention is versatile and highly desirable for the function of loading sheets into the hopper of a gatherer.

BRIEF DESCRIPTION OF THE DRAWINGS

FIGS. 5 and 6 are side and top views, respectively of another embodiment of this invention.

DETAILED DESCRIPTION OF THE PREFERRED METHOD AND EMBODIMENTS

Figure 1:
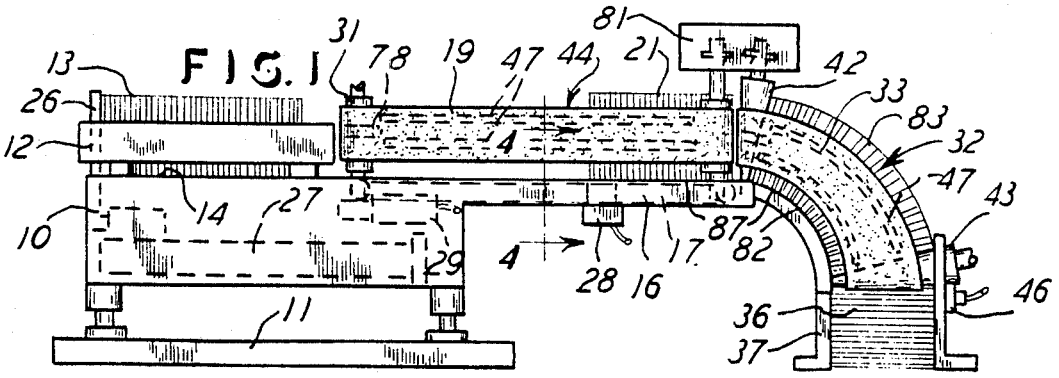
FIG. 1 is a side elevational view of one embodiment of this invention and showing it related to a portion of a hopper.
Figure 2:
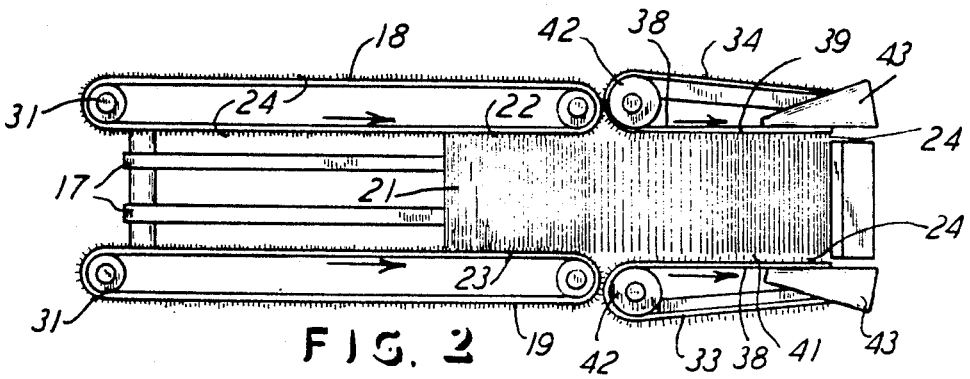
FIG. 2 is a top plan view of the invention shown in FIG. 1.

The apparatus will now be described, in conjunction with the drawings, and, as such, the method will also be revealed in that description. FIGS. 1 and 2 show one embodiment of the apparatus where a table 10 is shown suitably supported, such as on a platform or a floor 11, then two spaced-part stack side supports, such as the support 12 extend along opposite sides of the table 10. Thus a stack of signatures 13 is supported on the table top 14 and between two of the uprightly extending and spaced-apart side supports 12 which are like sidewalls on opposite flanks of the stack 13. The two stationary members 12 have bristles or the like, as described in connection with other members hereinafter, for engaging the opposite sides of the stack 13 and thereby have the stack 13 remain in the upright and edge standing position, as shown in FIG. 1. Of course the stack 13 is positioned on the tabletop 14 by means of a robot, overhead crane, or any other apparatus or in any other manner.

The support or table 10 also extends into a portion designated 16 which can suitably support horizontally extending conveyor belts 17, as shown in FIG. 2. Also, endless belts 18 and 19 are supported on the table 10 and on opposite sides of the upstanding sheets or stack designated 21, and that being a stack which was previously positioned where the stack 13 is now shown and was then advanced to the position where the stack 21 is now shown. Thus, the belts 17 are endless belts and extend underneath the upstanding sheets or signatures, and the belts can move, and are preferably powered in a direction to have the sheets move rightwardly, as viewed in FIGS. 1 and 2. In conjunction with that, the belts 18 and 19 also move, such as in the direction arrows shown adjacent thereto, and therefore the belts 18 and 19 are disposed to engage the opposite edges 22 and 23, respectively, of the sheets or stack 21, and thus retain the sheets on their upstanding or edge standing position, as shown. It will now also be seen and understood that the belts 18 and 19 have bristles 24 thereon and extending outwardly therefrom for engagement of the opposite sides or edges 22 and 23 of the upstanding sheets 21 to thus retain the sheets in the edge standing position shown. The bristles 24 extend into positions between adjacent ones of sheets 21, or the bristles 24 can flex and thereby press against the sheet edges 22 and 23 to retain the upstanding sheet position desired and shown.

In that arrangement, the belts 17 and the two belts 18 and 19 move in the direction of the arrows shown and at the same speed so that the sheets 21 are advanced rightwardly, as viewed in Figs. 1 and 2. The belts 18 and 19 form at least a portion of a sheet conveyor which is advancing the sheets toward the gatherer, to be described later.

FIG. 1 further shows an upstanding pusher 26 which is disposed in line with the stack 13 and which extends downwardly to a fluid cylinder 27 supported on the bed 10. With that arrangement, the cylinder 27 can move the pusher 26 rightwardly, to advance the stack 13 into the confines of the belts 17, 18, and 19, such as toward the position of the sheets designated 21. A detector 28, such as a photocell, can be positioned on the table 10 and thus detect the absence of any sheets in the position of the sheets 21, and, the detector 28 can be suitably operatively connected with the fluid cylinder 27 to control the actuation of the cylinder 27 for advancing the pusher 26 rightwardly to thus load the sheets into the position of the sheets 21, as needed. Such arrangement could be through any conventional means of a photocell type of detector 28 and electric or pneumatic connections with the fluid cylinder 27.

Also, a drive motor 29 is suitably engaged with a driven roller 31 on which the belt 19 is trained, and a likewise driven roller 31 is on the table 10 for the belt 18, as shown in FIG. 2. With that arrangement, the motor 29 will drive the two rollers 31 in the appropriate direction for advancing the belts 18 and 19, as shown by the arrows thereon, to thereby advance the sheets 21 rightwardly. The belt 17 can also be connected with the drive 29 so that uniform movement of those belts is achieved for control and rightward movement of the sheets 21.

Another portion of the conveyor is arcuate and designated 32 and it extends directly off the first portion of the conveyors 18 and 19, as shown. Thus the conveyor portion 32 is curved downwardly and, as shown, extends through a right angle or 90 degree downward curve, but any other angulation with respect to the horizontal orientation of the conveyors 18 and 19 could also be utilized.

The portion 32 is shown to have two spaced-apart belts 33 and 34, again on opposite sides of the sheets of the stack 21, for engaging the opposite sides and thus controlling the sheets in a edge standing and radial orientation through the commencement of the downward turn and at least until the sheets are deposited in a flat or horizontal orientation designated 36 in the confines of a hopper 37 which leads into a conventional type of sheet gatherer.

The two conveyor belts 33 and 34 are thus spaced-apart and are parallel to each other through portions designated 38, that is parallel to the sides designated 39 and 41 of the sheets 21. Again, there are rollers, this time in the form of tapered rollers 42 and 43 which are at the terminal ends of the respective belts 33 and 34 so that the belts can move endless and in the direction of the arrows adjacent the side portions 39 and 41, all for advancing the sheets 21 first horizontally and then downwardly into the horizontal orientation designated at 36.

The first conveyor portion is designated 44, and it forms a continuous conveyor with the other portion 32, all so that the sheets are initially moved in a horizontal component or in a horizontal plane, and they are subsequently moved downwardly in an arcuate direction by means of the conveyor portion 32. With that arrangement, the initial stack of sheets 13 need not be placed into a shingled arrangement for purposes of feeding the hopper 37, and, by appropriate sensing or detecting members, such as the detector 28 and a hopper sensor 46, the conveyor can be operated to supply the hopper 37 with the required sheets in the horizontal orientation 36. Thus, a sensor 46 is on the hopper 37 and senses the absence of sheets in the position designated 36, and that sensor 46 thus extends to the drive control 29 for controlling the motor or drive 29 and thereby operating the conveyor for advancing the sheets to the hopper 37.

Figure 3:
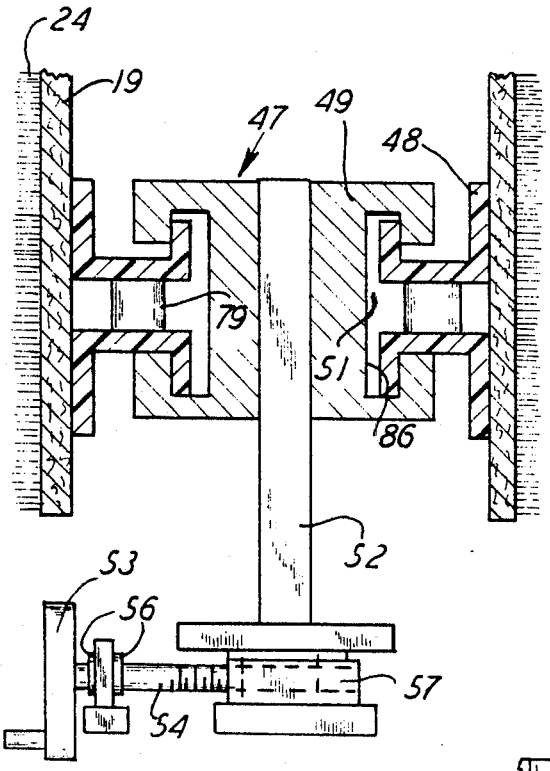
FIG. 3 is an enlarged sectional view taken along the line 3—3 of FIG. 1.

The embodiment shown in FIGS. 1 and 2 is that of a belt type of conveyor, and it may be provided with guide tracks, such as the track designated 47, which are adjacent the upper and lower edges of the belt in both portions 44 and 32. Also, FIG. 3 shows an enlargement of one arrangement for the guide tracks 47. Thus, the fragment of the belt 19 is shown, along with its bristles 24 extending outwardly thereon, and angled members 48 are suitably affixed to the back of the belt 19 and extend into a slotted guide 49 for riding along the slot 51 of the guide 49 which is thus stationarily mounted on an upstanding support 52. With that arrangement, the belt 19 can move endlessly over its rollers 31 while being guided in the stationary guides 49 when the belt 19 is in contact with the side of the sheets 21 and also when it is away from the sheets 21 on its return run to the point of beginning again. Of course belt 18 would be similarly guided, and, belts 33 and 34 would also be similarly guided by means of the guides shown in FIG. 3 or by any other conventional guide means, such as shown in connection with an arcuately extending conveyor belt manufactured and sold by FLOMASTER DIVISION OF PORTEC INC. of Canon City, Colo.

Thus, in any suitable manner, the belts forming this conveyor are suitably supported to present upstanding or vertical planes on opposite sides of the upstanding sheets, and the belts have faces which are not smooth and those faces are irregularly shaped or roughened or bristled or like faces presented to the edges of the sheets for holding the sheets in the position of either upstanding or reclining position, such as shown in the arcuate path on the portion 32.

The side conveyor belts can also move toward and away from the sheets, such as by means of an adjustment connected with the support 52 shown in FIG. 3. Thus, a crank 53 has a threaded shaft 54 which is axially restrained by supports 56. The shaft 54 engages a nut at 57 which in turn is connected with the standard 52. Thus, upon rotation of the threaded shafts 54, the nut 57 will be displaced to either the left or the right, and thus the standard 52 will likewise be displaced for moving the belt toward or away from the sheets 21, as desired.

Figure 4:
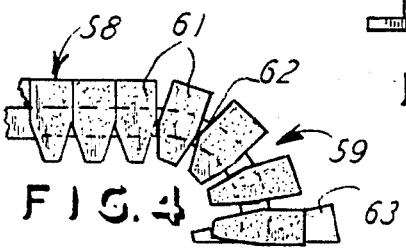
FIG. 4 is a side elevational view of a modified portion of the embodiment shown in FIG. 1.

FIG. 4 shows the conveyor to be in one continuous chain arrangement, and thus both the horizontal portion 58 and the downwardly curved portion 59 are on the same chain or conveyor and extend through the complete path as shown with the conveyor portions 44 and 32 in FIG. 1. In FIG. 4, the conveyor is thus comprised of side links 61 suitably joined together by a flexible chain member designated 62 which extends around the turnaround and tapered roller 63, as in connection with FIG. 1. The faces of the link 61 can be non-smooth to have the irregular shaped or roughened surfaces, such as having bristles thereon, all for presenting the roughened or bristled surfaces to the edges of the sheets 21, as previously described.

Figure 5:
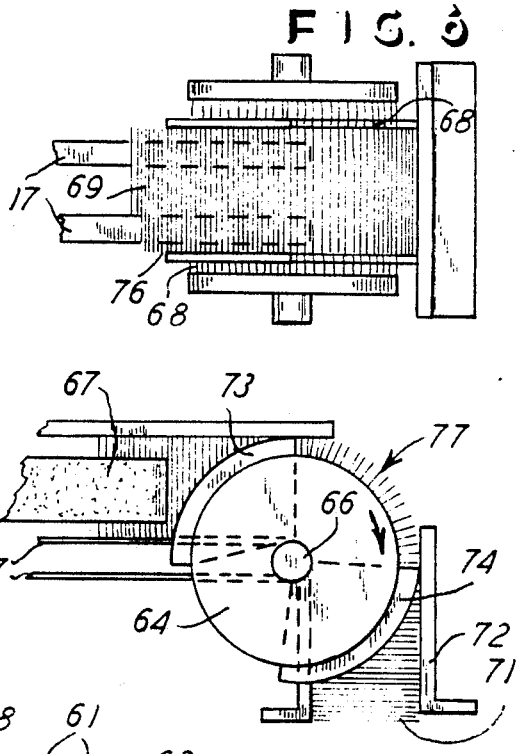

FIGS. 5 and 6 show a somewhat different apparatus and method in that the downwardly extending portion of the conveyor is comprised of a circular brush 64 rotatably mounted on a shaft 66 for rotation in the direction of the arrow shown thereon. Thus, the brush 64 is disposed at the turndown or arcuate portion of the conveyor coming off the horizontal conveyor run designated 67 which again could be the belts 18 and 19. The brush 64 has its bristles 68 extended toward the edges of the sheets designated 69 to thus support the sheets in their fanning or turning mode as they move from the upstanding edge position on the conveyor 67 and down to the horizontal orientation designated 71 in the hopper 72.

In that embodiment, it is preferred that at least two quarter portions of the circular brush 64 be blocked from touching the edges of the sheets 69, such as by the insulating stationary segment sheets 73 and 74 which are interposed between the brush bristle 68 and the sheet edges 76. Of course, through the quarter turn designated 77, the brush bristles 68 are in contact with the sheet edges 76 for guiding the sheets from the upstanding or vertical position and around to the reclining or horizontal orientation position in the hopper 72. Again, the speed of rotation of the brush 64 would be suitable for coordinating the movement of the sheet 69 with respect to their movement under the influence of the conveyor 67, all so that the hopper 72 can be properly loaded with sheets, as needed.

For purposes of driving the conveyor belts, in the belt modes disclosed herein, the control rollers 31 and 42 could be provided with sprockets designated 78 for purposes of engaging cylindrical portions 79 on the backs of the belts or on the backs of the chain of FIG. 4. Further, the belt portions 44 and 32 are shown to be drivingly interconnected through a drive box 81 which has the necessary conventional drive transmitters so that the belts 33 and 34 at their inner arcuate portions 82 will move at the liner speed of the horizontal displacement of the sheets as induced by the conveyor portion 44. That is, there will be no binding or jamming of sheets through the arcuate portion 32, and the sheets will of course be fanning in open or spaced-apart position at the outer arcuate path 83. Therefore, the speed along the inner arcuate path 82 is at least as fast as the horizontal speed induced by the conveyor portion 44. With the foregoing description of the apparatus embodiments, the method will be apparent in that sheets are moved in a horizontal component of movement and are then directed at an angle to that component, namely, downwardly in arcuate path and are placed into a horizontal orientation which of course may be inclining with respect to the horizontal as well as full horizontal orientation in the hoppers described.

With the separate conveyor 32, it can also be driven independent of the drive of the conveyor 44. Desired loading of the hopper 37 can again also be achieved, as well as the desired speed of the movement of the sheets through the arc.

Also, FIG. 3 shows the conveyors can be laterally adjusted to move toward and away from the sheet opposite sides. The standard 52 can be moved to have the surface 86 press against the backing strip 48 to have the bristles 24 move closer to the sheets. The sheets all have lower edges 87, and the two opposite side edges 22, 23, and 39, 41, contiguous to the lower edges 87.

What is claimed is:

1. In a conveyor for feeding sheets along a horizontal and then downward path to a sheet gatherer which includes a hopper for receiving sheets in a reclining orientation, the improvement comprising a sheet-supporting movable conveyor, a first portion of said conveyor having means for supporting sheets in an orientation of standing on one edge and for advancing the sheets along said horizontal path and toward the hopper, and a second portion of said conveyor including two spaced-apart upright sides directed and movable downwardly along said downward path and respectively engaging said sheets two opposite edges which are contiguous to said one edge, for directing and supporting said sheets into said reclining orientation, and for depositing said sheets horizontally into the hopper.

2. The conveyor for feeding sheets to a sheet gatherer which includes a hopper for receiving sheets in a reclining orientation as claimed in claim 1, both of said upright sides terminate in irregularly shaped faces arranged to releasably grip said sheet's opposite edges for supporting said sheets during conveyance thereof.

3. The conveyor for feeding sheets to a sheet gatherer which includes a hopper for receiving sheets in a reclining orientation as claimed in claim 2, wherein said upright sides include bristles directed toward said sheet's opposite edges and present said irregularly shaped faces.

4. The conveyor for feeding sheets to a sheet gatherer which includes a hopper for receiving sheets in a reclining orientation as claimed in claim 2, wherein both said means for supporting sheets and said upright sides include bristles directed toward said sheet's opposite edges and present said irregularly shaped faces.

5. The conveyor for feeding sheets to a sheet gatherer having a hopper for receiving sheets in a reclining orientation as claimed in claim 1, wherein both said means for supporting sheets and said upright sides terminate in irregularly shaped faces arranged to releasably grip said sheet's opposite edges for supporting said sheets during conveyance thereof.

6. The conveyor for feeding sheets to a sheet gatherer which includes a hopper for receiving sheets in a reclining orientation as claimed in claim 1, including a drive means respectively connected with each of said first portion and said second portion for driving both said portions, and said drive means for said second portion operable at a speed for driving said second portion at a linear speed which is at least as fast as that of said first portion.

7. The conveyor for feeding sheets to a sheet gatherer which includes a hopper for receiving sheets in a reclining orientation as claimed in claim 1, including drive means connected to said conveyor for driving said conveyor, a sensor operatively connected with said drive means for controlling operation of said drive means in accordance with the rate of movement of the sheets into the hopper.

8. The conveyor for feeding sheets to a sheet gatherer which includes a hopper for receiving sheets in a reclining orientation as claimed in claim 1, wherein said two spaced-apart upright sides each include a circular brush having bristles projected into said downwardly directed path for engaging and controlling the sheets.

9. A conveyor for feeding sheets to a sheet gatherer which includes a hopper for receiving sheets in a reclining orientation, comprising a sheet-supporting movable conveyor, a first portion of said conveyor having means for supporting sheets in an orientation of standing on one edge and for advancing the sheets in a horizontal path toward the hopper, and a second portion of said conveyor having means extending in a downwardly directed path at an angle to said first portion and including two spaced-apart upright sides for engaging said sheets opposite edges which are contiguous to said one edge, each of said two spaced-apart upright sides includes an endless belt disposed in an arcuate path which presents said downwardly directed path, for directing and supporting said sheets into said reclining orientation and for depositing said sheets horizontally into the hopper.

10. The conveyor for feeding sheets to a sheet gatherer which includes a hopper for receiving sheets in a reclining orientation as claimed in claim 9, wherein both of said upright sides terminate in irregularly shaped faces arranged to releasably grip said sheet's opposite edges for supporting said sheet's opposite edges for supporting said sheets during conveyance.

11. The conveyor for feeding sheets to a sheet gatherer which includes a hopper for receiving sheets in a reclining orientation as claimed in claim 9, wherein said upright sides include bristles directed toward said sheet's opposite edges and present said irregularly shaped faces.

12. a conveyor for feeding sheets to a sheet gatherer, comprising a hopper for receiving sheets in a reclining orientation, conveyor means for supporting sheets in upstanding orientation from a lower edge and in side-by-side relationship and conveying said sheets along a path having a horizontal component, said conveyor means including arcuately moveable and two spaced-apart upright sides engaged with respective sides of said sheets adjacent said lower edge and being curved downwardly from said path and from the remainder of said conveyor means and being operable for movement to convey the side-by-side said sheets along a downwardly terminating arcuate path to deposit said sheets in said reclining orientation in the hopper.

13. The conveyor for feeding sheets to a sheet gatherer which includes a hopper for receiving sheets in a reclining orientation, as claimed in claim 12, wherein said conveyor means includes bristles for contact with said sheets in the conveyance thereof.

14. A method for feeding sheets to a sheet gatherer including a hopper for receiving sheets in a reclining orientation, comprising the steps of conveying sheets in an upright edge-standing orientation along a horizontal path, flanking said sheets' opposite edges which are adjacent the standing edge with two spaced-apart and movable conveyors to have said sheets in the space between said conveyors and uniformly convey said sheets both along said horizontal path and then into an arcuate path directed downwardly from said horizontal path while engaging and moving said opposite edges with said two spaced-apart and movable conveyors, and directing the movable path of said two conveyors downwardly while still engaging said sheets, and positioning said sheets in said reclining orientation, and laying said sheets down in the hopper in said reclining orientation while releasing said two conveyors from said opposite edges.

15. The method for feeding sheets to a sheet gatherer which includes a hopper for receiving sheets in a reclining orientation, as claimed in claim 14, including supporting said sheets on their standing edges with an additional conveyor, and conveying said sheets to have said standing edges move along said arcuate path and at a speed which is at least as great as the speed of conveyance of said standing edges along said horizontal path.

* * * * *